US009404513B2

(12) United States Patent
Baker et al.

(10) Patent No.: US 9,404,513 B2
(45) Date of Patent: Aug. 2, 2016

(54) SERVO VALVE

(71) Applicant: Woodward, Inc., Fort Collins, CO (US)

(72) Inventors: Carthel Baker, Oregon, IL (US); Adam Kurzynski, Huntley, IL (US)

(73) Assignee: Woodward, Inc., Fort Collins, CO (US)

( * ) Notice: Subject to any disclaimer, the term of this patent is extended or adjusted under 35 U.S.C. 154(b) by 77 days.

(21) Appl. No.: 14/249,960

(22) Filed: Apr. 10, 2014

(65) Prior Publication Data

US 2015/0292525 A1 Oct. 15, 2015

(51) Int. Cl.

*F15B 13/044* (2006.01)
*F15B 9/08* (2006.01)
*F15B 13/043* (2006.01)

(52) U.S. Cl.

CPC ..... *F15B 13/0438* (2013.01); *F15B 9/08* (2013.01); *F15B 13/044* (2013.01)

(58) Field of Classification Search

CPC ..... F15B 13/0438; F15B 9/08; G05D 7/0635; F13B 13/0436

See application file for complete search history.

(56) References Cited

U.S. PATENT DOCUMENTS

| | | | | |
|---|---|---|---|---|
| 2,931,389 | A | 4/1960 | Moog, Jr. et al. | |
| 3,023,782 | A | 3/1962 | Chaves, Jr. et al. | |
| 3,777,784 | A * | 12/1973 | Nicholson | 137/625.62 |
| 5,465,757 | A * | 11/1995 | Peters | 137/625.65 |
| 8,166,765 | B2 | 5/2012 | Baker et al. | |
| 8,172,551 | B2 | 5/2012 | Baker | |
| 8,192,172 | B2 | 6/2012 | Baker et al. | |
| 8,302,406 | B2 | 11/2012 | Baker | |
| 8,348,630 | B2 | 1/2013 | Tysver et al. | |
| 2012/0156061 | A1 | 6/2012 | Baker et al. | |
| 2012/0315152 | A1 | 12/2012 | Baker | |
| 2013/0042920 | A1 | 2/2013 | Snodgrass et al. | |
| 2013/0043331 | A1 | 2/2013 | Snodgrass et al. | |

FOREIGN PATENT DOCUMENTS

| | | |
|---|---|---|
| EP | 1249651 | 10/2002 |

OTHER PUBLICATIONS

PCT International Search Report and Written Opinion of the International Searching Authority, PCT/US2015/024477, Jul. 17, 2015, 10 pages.

* cited by examiner

*Primary Examiner* — Kevin Murphy
*Assistant Examiner* — Patrick Williams
(74) *Attorney, Agent, or Firm* — Fish & Richardson P.C.

(57) ABSTRACT

A servo valve includes a valve housing, a piston cylinder disposed in the housing, a piston disposed within the piston cylinder and fluidly connected on a first end to a first fluid pressure pathway and on a second end to a second fluid pressure pathway, a flapper assembly, and a flow control element disposed in the piston cylinder in a portion of the first fluid pressure pathway. The piston is configured to translate axially within the piston cylinder in response to a pressure differential between the first fluid pressure pathway and the second fluid pressure pathway. The fluid flow control element is configured to stop a flow of fluid through the first fluid pressure pathway when the piston engages the third fluid control element.

25 Claims, 7 Drawing Sheets

SERVO VALVE

BACKGROUND

This specification generally relates to a servo valve, and more particularly to a hydraulic servo valve for regulating fluid flow.

Servo valves can be used to control fluid flow, for example, in hydraulic systems and continuous fluid flow systems. In some implementations, servo valves include a movable piston in a housing actuated by a movable flapper.

SUMMARY

The description below relates to servo valves.

In some aspects, a servo valve includes a valve housing, a piston cylinder disposed in the housing, a piston disposed within the piston cylinder, and a flapper assembly. The piston is fluidly connected on a first end to a first fluid pressure pathway, and fluidly connected on a second end to a second fluid pressure pathway. The piston is configured to translate axially within the piston cylinder in response to a pressure differential between a first fluid in the first fluid pressure pathway and a second fluid in the second fluid pressure pathway. The flapper assembly includes an activation portion and closure portion. The closure portion extends from the activation portion, and the flapper assembly is configured to move the closure portion to engage a first fluid flow control element on the first fluid pressure pathway when the closure portion is in a first position, and configured to move the closure portion to engage a second fluid flow control element on the second fluid pressure pathway when the closure portion is in a second position. The servo valve also includes a third fluid flow control element disposed in the piston cylinder in a portion of the first fluid pressure pathway. The third fluid flow control element is configured to stop a flow of fluid through the first fluid pressure pathway when the piston engages the third fluid control element.

In some aspects, a method of operating a servo valve includes providing a servo valve that includes a valve housing, a piston cylinder disposed in the housing, a piston disposed within the piston cylinder, and a flapper assembly. The piston is fluidly connected on a first end to a first fluid pressure pathway, and fluidly connected on a second end to a second fluid pressure pathway. The piston is configured to translate axially within the piston cylinder in response to a pressure differential between a first fluid in the first fluid pressure pathway and a second fluid in the second fluid pressure pathway. The flapper assembly includes an activation portion and closure portion. The closure portion extends from the activation portion, and the flapper assembly is configured to pivotably move the closure portion to engage a first fluid flow control element on the first fluid pressure pathway when the closure portion is in a first position, and configured to move the closure portion to engage a second fluid flow control element on the second fluid pressure pathway when the closure portion is in a second position. The servo valve also includes a third fluid flow control element disposed in the piston cylinder in a portion of the first fluid pressure pathway. The third fluid flow control element is configured to stop a flow of fluid through the first fluid pressure pathway when the piston engages the third fluid control element. The method further includes moving the closure portion of the flapper assembly to a first position, where the closure portion of the flapper assembly engages with the second flow control element, resulting in a pressure differential between the first fluid pressure pathway and second fluid pressure pathway that translates the piston within the piston cylinder to a first position, where the piston engages the third flow control element to seal the first fluid pressure pathway.

Some implementations may include one or more of the following features. The flapper assembly further includes one or more electrical coils disposed proximal to the activation portion of the flapper assembly. The first fluid control element includes a first nozzle in the first fluid pressure pathway configured to seal against the closure portion of the flapper assembly when the closure portion engages the first nozzle, and the second fluid control element includes a second nozzle in the second fluid pressure pathway configured to seal against the closure portion of the flapper assembly when the closure portion engages the second nozzle. The servo valve includes a fourth fluid control element disposed in the piston cylinder in a portion of the second fluid pressure pathway, the fourth fluid control element configured to stop a flow of fluid through the second fluid pressure pathway when the piston engages the fourth fluid control element. An outer periphery portion of the piston pressure-seals against an inner surface of the piston cylinder. The first fluid pressure pathway is connected on one end to a high pressure fluid pathway via a first pressure change element and on another end to a low pressure fluid pathway via the first fluid flow control element in the first fluid pathway. The second fluid pressure pathway is connected on one end to the high pressure fluid pathway via a second pressure change element and on another end to the low pressure fluid pathway via the second fluid flow control element in the second fluid pathway. The piston includes an outer groove disposed circumferentially in a substantially cylindrical outer surface of the piston. The piston cylinder includes an opening in a sidewall of the piston cylinder fluidly connected to a high pressure fluid pathway, an opening in a sidewall of the piston cylinder fluidly connected to a low pressure fluid pathway, and an opening in a sidewall of the piston cylinder fluidly connected to an output fluid pathway. The opening to the output fluid pathway is positioned in the piston cylinder such that when the groove in the piston translates as the piston moves axially, fluid in the groove remains in fluid communication with the opening to the output fluid pathway. The opening to the high pressure fluid pathway is spaced apart from and positioned in the sidewall to a first side of the opening to the output fluid pathway, and the opening to the low pressure fluid pathway is spaced apart from and positioned in the sidewall to a second side of the opening to the output fluid pathway in an opposite axial direction from the opening to the high pressure fluid pathway. The opening to the high pressure fluid pathway is positioned in the piston cylinder such that when the groove in the piston translates as the piston moves axially in a first direction, fluid in the groove remains in fluid communication with the opening to the high pressure fluid pathway and an outer surface of the piston closes the opening to the low pressure fluid pathway. The opening to the low pressure fluid pathway is positioned in the piston cylinder such that when the groove in the piston translates as the piston moves axially in a second direction opposite the first direction, fluid in the groove remains in fluid communication with the opening to the low pressure fluid pathway and an outer surface of the piston closes the opening to the high pressure fluid pathway. The piston includes a second outer groove disposed circumferentially in the substantially cylindrical outer surface of the piston. The piston cylinder includes a second opening in the sidewall of the piston cylinder fluidly connected to the high pressure fluid pathway, a second opening in the sidewall of the piston cylinder fluidly connected to the low pressure fluid pathway, and an opening in the sidewall of the piston cylinder fluidly connected to a second output fluid pathway. The opening to the second output fluid pathway is positioned in the piston cylinder such that when the groove in the piston translates as the piston moves axially, fluid in the second groove remains in fluid communication with the opening to the second output fluid pathway. The second opening to the high pressure fluid pathway is spaced apart from and positioned in the sidewall to a first side of the opening to the second output fluid pathway, and the second opening to the low pressure fluid pathway is spaced apart from and positioned in the sidewall to a second side of the opening to the second output fluid pathway in an opposite axial direction from the second opening to the high pressure fluid pathway. The second opening to the low pressure fluid pathway is positioned in the piston cylinder such that when the second groove of the piston translates as the piston moves axially in the first direction, fluid in the second groove remains in fluid communication with the second opening to the low pressure fluid pathway and an outer surface of the piston closes the second opening to the high pressure fluid pathway. The second opening to the high pressure fluid pathway is positioned in the piston cylinder such that when the second groove of the piston translates as the piston moves axially in the second direction, fluid in the second groove remains in fluid communication with the second opening to the high pressure fluid pathway and an outer surface of the piston closes the second opening to the low pressure fluid pathway. The first mentioned output fluid pathway and the second output fluid pathway are operably connected to a hydraulic drive system. The servo valve includes a feedback spring connected to the closure portion of the flapper assembly on one end and the piston on another end. The closure portion of the flapper assembly is movably attached to the housing. The closure portion of the flapper assembly is rotatably attached to the housing by a pivot, wherein the pivot comprises a pivot spring. The method includes moving the closure portion of the flapper assembly to a second position, where the closure portion engages with the second flow control element, resulting in a pressure differential between the first fluid pressure pathway and second fluid pressure pathway that translates the piston within the piston cylinder to a second position, where the piston engages a fourth flow control element to seal the second fluid pressure pathway. The fourth flow control element is disposed in the piston cylinder in a portion of the second fluid pressure pathway, and the fourth flow control element is configured to stop a flow of fluid through the second fluid pressure pathway when the piston engages the fourth fluid control element. Moving the closure portion of the flapper assembly to a first position includes providing an electrical input to one or more coils disposed proximal to the activation portion of the flapper assembly and thereby moving the closure portion of the flapper assembly to a first position. The method includes connecting the output fluid pathway to a hydraulic drive system.

BRIEF DESCRIPTION OF THE DRAWINGS

Like reference symbols in the various drawings indicate like elements.

DETAILED DESCRIPTION

Figure 1:
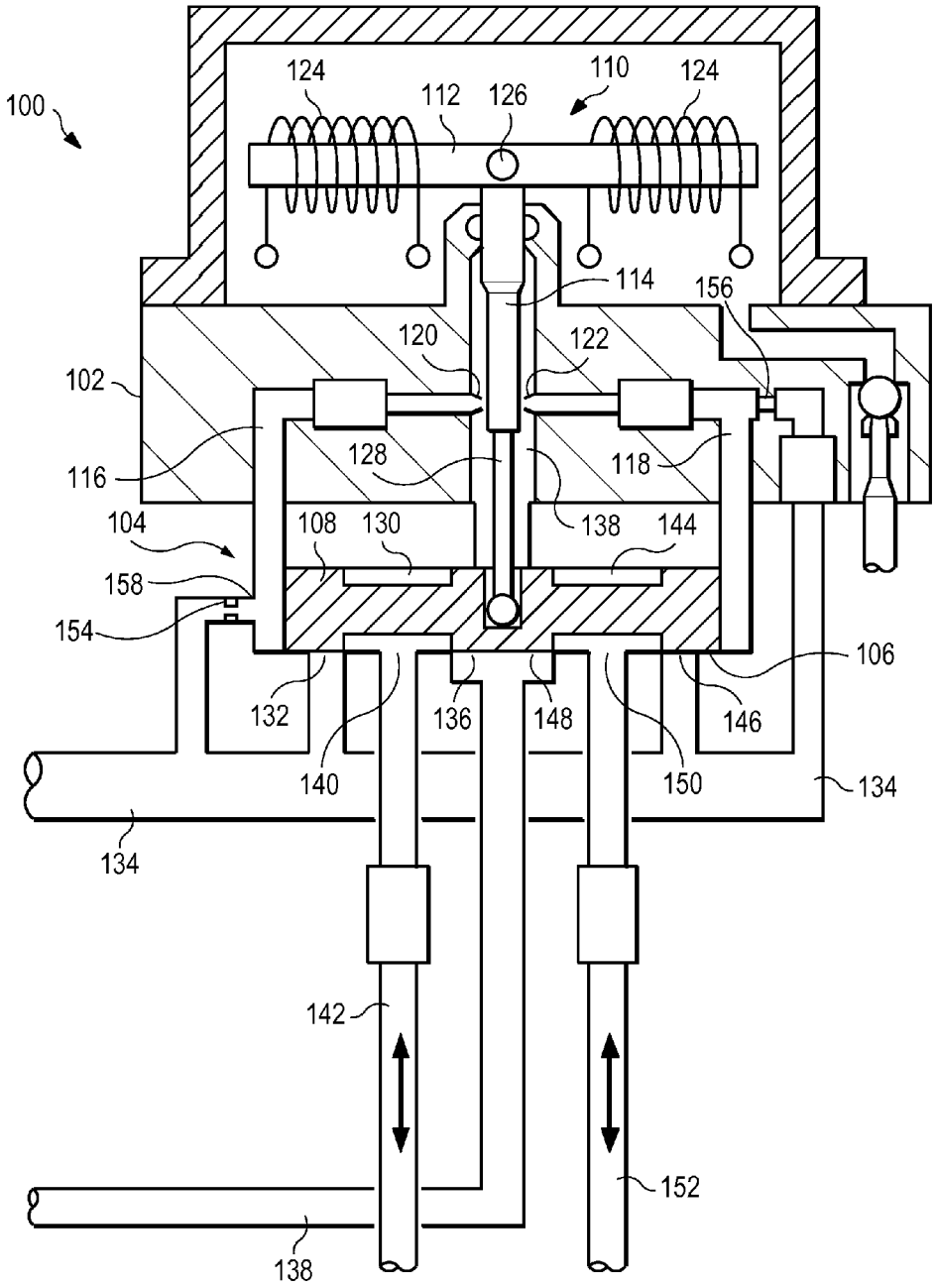
FIG. 1 is a schematic, partial cross-sectional front view of an example electrohydraulic servo valve.

FIG. 1 shows an example electrohydraulic servo valve ("EHSV") 100 in a schematic, partial cross-sectional front view. The EHSV 100 includes a valve housing 102, a piston cylinder 104 with a sleeve 106 disposed in the housing 102, a piston 108 disposed in the sleeve 106, and a flapper assembly 110 with an activation portion 112 and a closure portion 114. It will be understood that the sleeve 106 is not a required element for implementation of this disclosure. In alternate embodiments, the piston 108 may be disposed directly in a bore of the piston cylinder 104. The piston 108 is fluidly connected on a first end to a first fluid pressure pathway 116, and is fluidly connected on a second end to a second fluid pressure pathway 118. The piston 108 is configured to translate axially within the sleeve 106 in response to a pressure differential between a first fluid in the first fluid pressure pathway 116 and a second fluid in the second fluid pressure pathway 118. The closure portion 114 of the flapper assembly 110 extends from the activation portion 112, and the flapper assembly 110 is configured to move the closure portion 114. In some instances, the flapper assembly 110 is configured to move the closure portion 114 to engage a first fluid flow control element 120 on the first fluid pressure pathway 116 when the closure portion 114 is in a first position, and is configured to move the closure portion 114 to engage a second fluid flow control element 122 on the second fluid pressure pathway 118 when the closure portion 114 is in a second position.

In certain instances, the first fluid flow control element 120 includes a first nozzle in the first fluid pressure pathway 116, and the second fluid flow control element 122 includes a second nozzle in the second fluid pressure pathway 118. The first nozzle is configured to seal against the closure portion 114 of the flapper assembly 110 when the closure portion 114 engages with the first nozzle in the first position. Similarly, the second nozzle is configured to seal against the closure portion 114 of the flapper assembly 110 when the closure portion 114 engages with the second nozzle in the second position. In other instances, the fluid flow control elements 120 and 122 include other, different flow control features.

The activation portion 112 of the flapper assembly 110 can be implemented in various manners. For example, the activation portion 112 can include a pressure activated diaphragm, a linear actuator, a pneumatic actuator, a servo motor, an armature with electrified coils about ends of the armature, and/or a different activation component. In the example shown in FIG. 1, the example EHSV 100 includes two electrical coils 124 disposed proximal to the activation portion 112 of the flapper assembly 110. The flapper assembly 110 is movably attached to the housing 102, for example, by a pivot spring 126 configured to resist rotation of the flapper assembly 110. In the example shown in FIG. 1, the two electrical coils 124 coil about opposite ends of the activation portion 112. In some instances, an electrical input, such as an input voltage or current, to the electrical coils 124 produces an electromagnetic force that results in a torque acting on the activation portion 112 to rotate the closure portion 114 to a specific position. In certain instances, the pivot spring 126 is configured to resist rotation of the flapper assembly 110 while the electrical coils 124 promote rotation of the flapper assembly 110, such that the rotation of the flapper assembly 110 is proportional to the electrical input to the electrical coils 124. The example EHSV 100 can include a different number of coils 124, for example, one coil, or three or more coils. In some instances, the coils 124 can include a solenoid, coiled copper wire, and/or other electrical components.

In some instances, the EHSV 100 includes a feedback spring 128 connected to the closure portion 114 of the flapper assembly 110 on one end and the piston 108 on another end. The feedback spring 128 is configured to provide a force balance between the piston 108 and the flapper assembly 110. For example, the piston 108 translates until torque on the flapper assembly 110 from the feedback spring 128 balances torque on the flapper assembly 110 applied by the electrical input of the electrical coils 124.

In some instances, an outer periphery portion of the piston 108 pressure-seals against an inner surface of the sleeve 106 such that the first fluid in the first fluid pressure pathway 116 is separated from the second fluid in the second fluid pressure pathway 118. For example, peripheries of the opposite ends of the piston 108 can seal against the sleeve 106 such that the first fluid is retained on one end of the sleeve 106 against a first end of the piston 108, and the second fluid is retained on an opposite end of the sleeve 106 against a second, opposite end of the piston 108. Pressure differentials between the first fluid and the second fluid can actuate the piston 108 to translate within the sleeve 106.

The cross-sectional shape of the piston 108 and sleeve 106 can vary. For example, the piston 108 and sleeve 106 can each have a rectangular, square, circular, or different cross-sectional shape. The piston 108 has the same cross sectional shape as the sleeve 106 such that a pressure seal can exist between the piston and the sleeve while allowing translative movement of the piston 108 within the sleeve 106. In an alternative embodiment without a sleeve 106, the piston cylinder 104 will be configured with a cross-section to slidably receive the piston 108 of a non-cylindrical cross-section. In the example shown in FIG. 1, the piston 108 is substantially cylindrical with a circular cross-sectional shape that matches (substantially or wholly) a substantially cylindrical inner sidewall of the sleeve 106. The piston 108 includes an outer groove 130 disposed circumferentially in a substantially cylindrical outer surface of the piston 108. The sleeve 106 includes an opening 132 in the sidewall of the sleeve 106 fluidically connected to a high pressure fluid pathway 134, an opening 136 in the sidewall of the sleeve 106 fluidically connected to a low pressure fluid pathway 138, and an opening 140 in the sidewall of the sleeve 106 fluidically connected to an output fluid pathway 142. The opening 140 to the output fluid pathway 142 is positioned in the sleeve 106 such that when the groove 130 in the piston 108 translates as the piston 108 moves axially, fluid in the groove 130 remains in fluid communication with the opening 140 to the output fluid pathway 142. The opening 132 to the high pressure fluid pathway 134 is spaced apart from and positioned in the sidewall to a first side of the opening 140 to the output fluid pathway 142, and the opening 136 to the low pressure fluid pathway 138 is spaced apart from and positioned in the sidewall to a second side of the opening 140 to the output fluid pathway 142 in an opposite axial direction from the opening 132 to the high pressure fluid pathway 134. The opening 132 to the high pressure fluid pathway 134 is positioned in the sleeve 106 such that when the groove 130 in the piston 108 translates as the piston 108 moves axially in a first direction, fluid in the groove 130 remains in fluid communication with the opening 132 to the high pressure fluid pathway 134 and an outer surface of the piston 108 closes the opening 136 to the low pressure fluid pathway 138 (See FIG. 3B). The opening 136 to the low pressure fluid pathway 138 is positioned in the sleeve 106 such that when the groove 130 in the piston 108 translates as the piston 108 moves axially in a second direction opposite the first direction, fluid in the groove 130 remains in fluid communication with the opening 136 to the low pressure fluid pathway 138 and an outer surface of the piston 108 closes the opening 132 to the high pressure fluid pathway 134 (See FIG. 3C).

In some instances, such as the example EHSV 100 of FIG. 1, the piston 108 includes a second outer groove 144 disposed circumferentially in the substantially cylindrical outer surface of the piston 108. The sleeve 106 includes a second opening 146 in the sidewall of the sleeve 106 fluidly connected to the high pressure fluid pathway 134, a second opening 148 in the sidewall of the sleeve 106 fluidly connected to the low pressure fluid pathway 138, and an opening 150 in the sidewall of the sleeve 106 fluidly connected to a second output fluid pathway 152. The opening 150 to the second output fluid pathway 152 is positioned in the sleeve 106 such that when the groove in the piston 108 translates as the piston 108 moves axially, fluid in the second groove remains in fluid communication with the opening 150 to the second output fluid pathway 152. The second opening 146 to the high pressure fluid pathway 134 is spaced apart from and positioned in the sidewall to a first side of the opening 150 to the second output fluid pathway 152, and the second opening 148 to the low pressure fluid pathway 138 is spaced apart from and positioned in the sidewall to a second side of the opening 150 to the second output fluid pathway 152 in an opposite axial direction from the second opening 146 to the high pressure fluid pathway 134. The second opening 148 to the low pressure fluid pathway 138 is positioned in the sleeve 106 such that when the second groove 144 of the piston 108 translates as the piston 108 moves axially in the first direction, fluid in the second groove 144 remains in fluid communication with the second opening 148 to the low pressure fluid pathway 138 and an outer surface of the piston 108 closes the second opening 146 to the high pressure fluid pathway 134. The second opening 146 to the high pressure fluid pathway 134 is positioned in the sleeve 106 such that when the second groove 144 of the piston 108 translates as the piston 108 moves axially in the second direction, fluid in the second groove 144 remains in fluid communication with the second opening 146 to the high pressure fluid pathway 134 and an outer surface of the piston 108 closes the second opening 148 to the low pressure fluid pathway 138. In some instances, the openings 136 and 148 to the low pressure fluid pathway 138 are a single opening in the sidewall of the sleeve 106. In other instances, the openings 132 and 146 to the high pressure fluid pathway 134 are a single opening in the sidewall of the sleeve 106.

In some instances, the first mentioned output fluid pathway 142, the second output fluid pathway 152, or both are operably connected to a hydraulic drive system, for example, a hydraulic actuator. The hydraulic actuator may be used to mechanically move an element of a device from a first position to a second position. By way of example and not limitation, the hydraulic output may be used to move an object (e.g. piston, actuator, fuel nozzle, etc.) on an aircraft from a first position to a second position and to intermediate positions there between.

In the example EHSV 100 shown in FIG. 1, the first fluid pressure pathway 116 is connected on one end to the high pressure fluid pathway 134 via a first pressure change element 154, and connected on another end to the low pressure fluid pathway 138 via the first fluid flow control element 120. The second fluid pressure pathway 118 is connected on one end to the high pressure fluid pathway 134 via a second pressure change element 156 and on another end to the low pressure fluid pathway 138 via the second fluid flow control element 122, with an intermediate section extending into the sleeve 106 proximate the second end of the piston 108. The first pressure change element 154 regulates pressure between fluid in the high pressure fluid pathway 134 and fluid in the first fluid pressure pathway 116 based on fluid flow through the first pressure change element 154. Similarly, the first fluid flow control element 120 regulates pressure between fluid in the low pressure fluid pathway 138 and fluid in the first fluid pressure pathway 116. For example, the first pressure change element 154 creates a pressure drop between the high pressure fluid pathway 134 and first fluid pressure pathway 116, and the first fluid flow control element 120 creates a pressure drop between the first fluid pressure pathway 116 and the low pressure fluid pathway 138, such that fluid in the first fluid pressure pathway 116 is at an intermediate pressure between the higher pressure in the high pressure fluid pathway 134 and the lower pressure in the low pressure fluid pathway 138. The second pressure change element 156 regulates pressure between fluid in the high pressure fluid pathway 134 and fluid in the second fluid pressure pathway 118 based on fluid flow through the second pressure change element 156. Similarly, the second fluid flow control element 122 regulates pressure between fluid in the low pressure fluid pathway 138 and fluid in the second fluid pressure pathway 118. For example, the second pressure change element 156 creates a pressure drop between the high pressure fluid pathway 134 and second fluid pressure pathway 118, and the second fluid flow control element 122 creates a pressure drop between the second fluid pressure pathway 118 and the low pressure fluid pathway 138, such that fluid in the second fluid pressure pathway 118 is at an intermediate pressure between the higher pressure in the high pressure fluid pathway 134 and the lower pressure in the low pressure fluid pathway 138. The first pressure change element 154 and second pressure change element 156 can each include a hydraulic bridge with an orifice, where the orifice is adapted to regulate pressure based on fluid flow through the orifice, for example, fluid flow from the high pressure fluid pathway 134 through the orifice and to the first fluid pressure pathway 116, or fluid flow from the high pressure fluid pathway 134 through the orifice and to the second fluid pressure pathway 118.

A third fluid flow control element 158 is disposed in the piston cylinder 104 in a portion of the first fluid pressure pathway 116. The third fluid flow control element 158 is configured to stop a flow of fluid through the first fluid pressure pathway 116 when the piston 108 engages the third fluid flow control element 158. The third fluid flow control element 158 can allow the example EHSV 100 to achieve a leakage shutoff condition for either a high pressure output or low pressure output in the output fluid pathway 142.

The third fluid flow control element 158 can take many forms. In the example implementation shown in FIG. 1, the third fluid flow control element 158 comprises an inlet opening of the first fluid pressure pathway 116 into the piston cylinder 104, where the piston 108 is configured to engage and block the inlet opening to stop a flow of fluid through the first fluid pressure pathway 116. In some instances, the third fluid flow control element 158 includes a seat in the opening of first fluid pressure pathway 116 into the piston cylinder 104, where the seat is configured to seal against the piston 108 when the piston 108 translates in the piston cylinder 104 and engages the seat. Fluid flow in the first fluid pressure pathway 116 is restricted (wholly or substantially) at the engagement of the piston 108 and the inlet opening and/or seat. In some instances (not shown), the third fluid flow control element 158 includes an extension or protrusion of the sleeve 106 or piston cylinder 104 into a portion of the first fluid pressure pathway 116, with the protrusion or extension configured to abut the piston 108 when the piston 108 translates in the piston cylinder 104 and engages the protrusion or extension. In other instances (not shown), the third fluid flow control element 158 includes an extension or protrusion of the piston 108 into the first fluid pressure pathway 116. The extension or protrusion of the piston 108 can be configured to seal against and engage a portion of the first fluid pressure pathway 116 such that fluid flow in the first fluid pressure pathway 116 is restricted (wholly or substantially) where the protrusion or extension of the piston 108 engages the portion of the first fluid pressure pathway 116. For example, the piston 108 can include a cylindrical protrusion at a longitudinal end of the piston 108 adjacent the first fluid pressure pathway 116, with the cylindrical protrusion configured to surround an opening of the first fluid pressure pathway 116 into a piston chamber portion of the first fluid pressure pathway 116. In another example (not shown), a cylindrical protrusion of the piston 108 is configured to be received in and substantially seal the opening of the first fluid pressure pathway 116 to the piston chamber portion of the first fluid pressure pathway 116. In other instances, the third fluid flow control element includes a fixed protrusion from the housing 102 into the first fluid pressure pathway 116 (See element 158' in FIGS. 3A, 3B, and 3C). In further instances (not shown), the third fluid flow control element 158 includes another, different component configured to stop a flow of fluid through the first fluid pressure pathway 116 when engaged with the piston 108.

Figure 4:
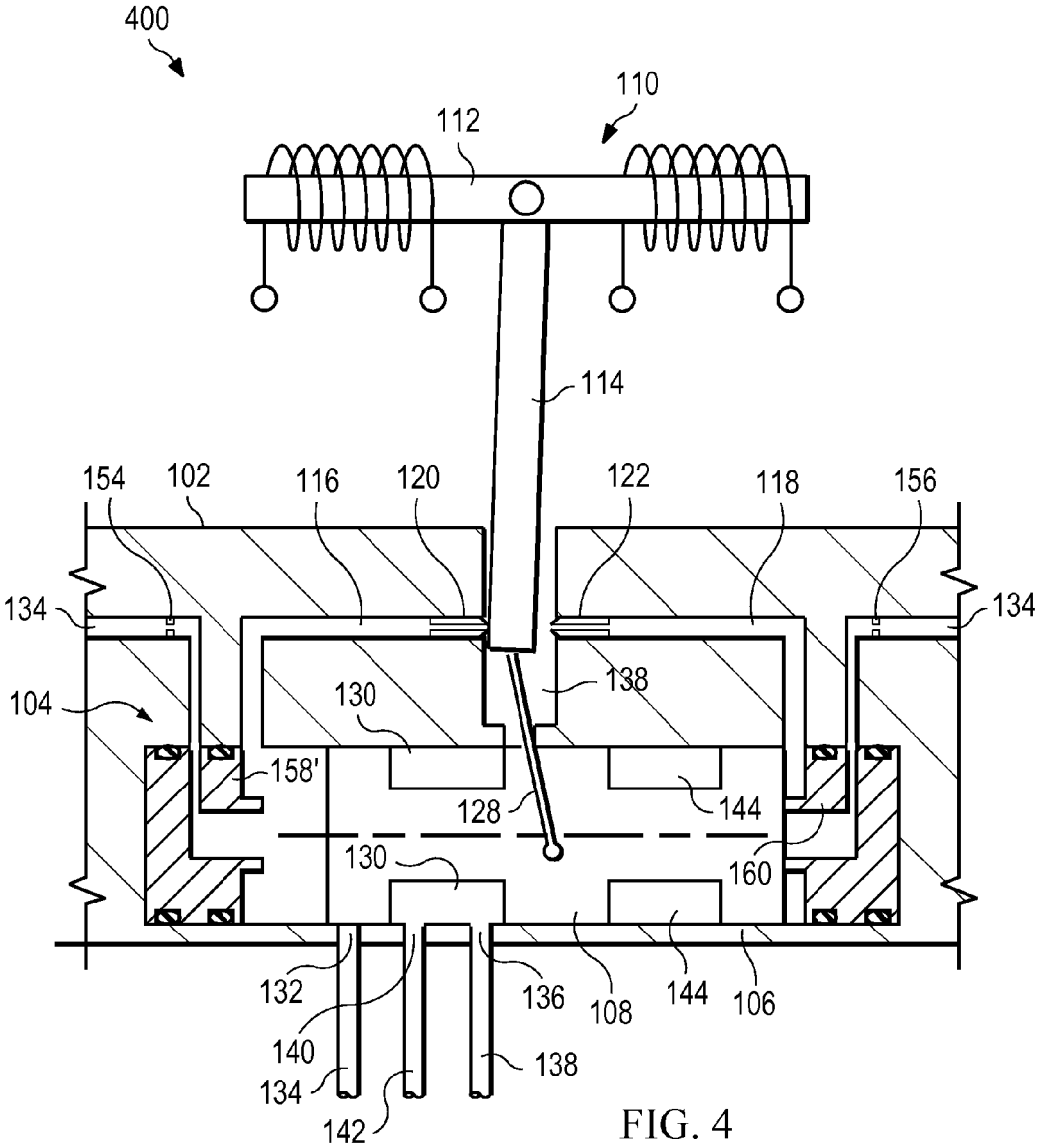
FIG. 4 is a schematic front view of an example servo valve in a second position.

In certain instances, the example EHSV 100 includes a fourth fluid flow control element (see FIG. 4) disposed in the piston cylinder 104 in a portion of the second fluid pressure pathway 118. For example, the second fluid pressure pathway 118 can mirror the first fluid pressure pathway 116 on an opposite side of the piston 108 from the first fluid pressure pathway 116. The fourth fluid flow control element is configured to stop a flow of fluid through the second fluid pressure pathway 118 when the piston 108 engages the fourth fluid control element. In certain instances, the fourth fluid flow control element includes elements and components of the third fluid flow control element 158. For example, the example servo valve 400 in FIG. 4 shows a fourth fluid flow control element 160 including a fixed protrusion from the housing 102 into the second fluid pressure pathway 118. An example servo valve with the third fluid flow control element 158 and the fourth fluid flow control element can achieve multiple leakage shutoff conditions. For example, a first leakage shutoff condition can correspond to a high pressure output for the output fluid pathway 142 when the third fluid flow control element 158 engages the piston 108, and a second leakage shutoff condition can correspond to a low pressure output for the output fluid pathway 142 when the fourth fluid flow control element engages the piston 108.

Figure 2A:
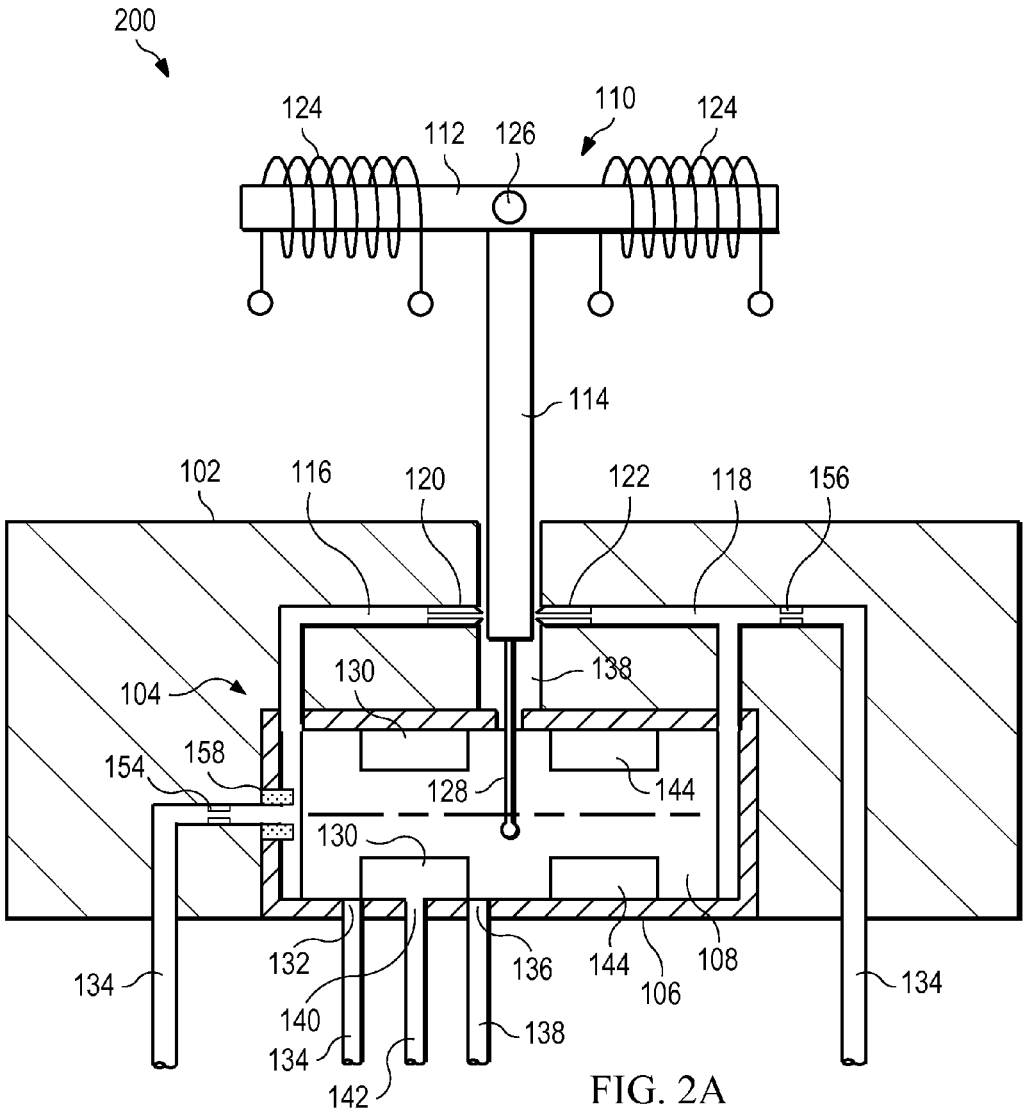
FIGS. 2A and 2B are schematic front views of an example electrohydraulic servo valve in a center position and a first position, respectively.
Figure 2B:
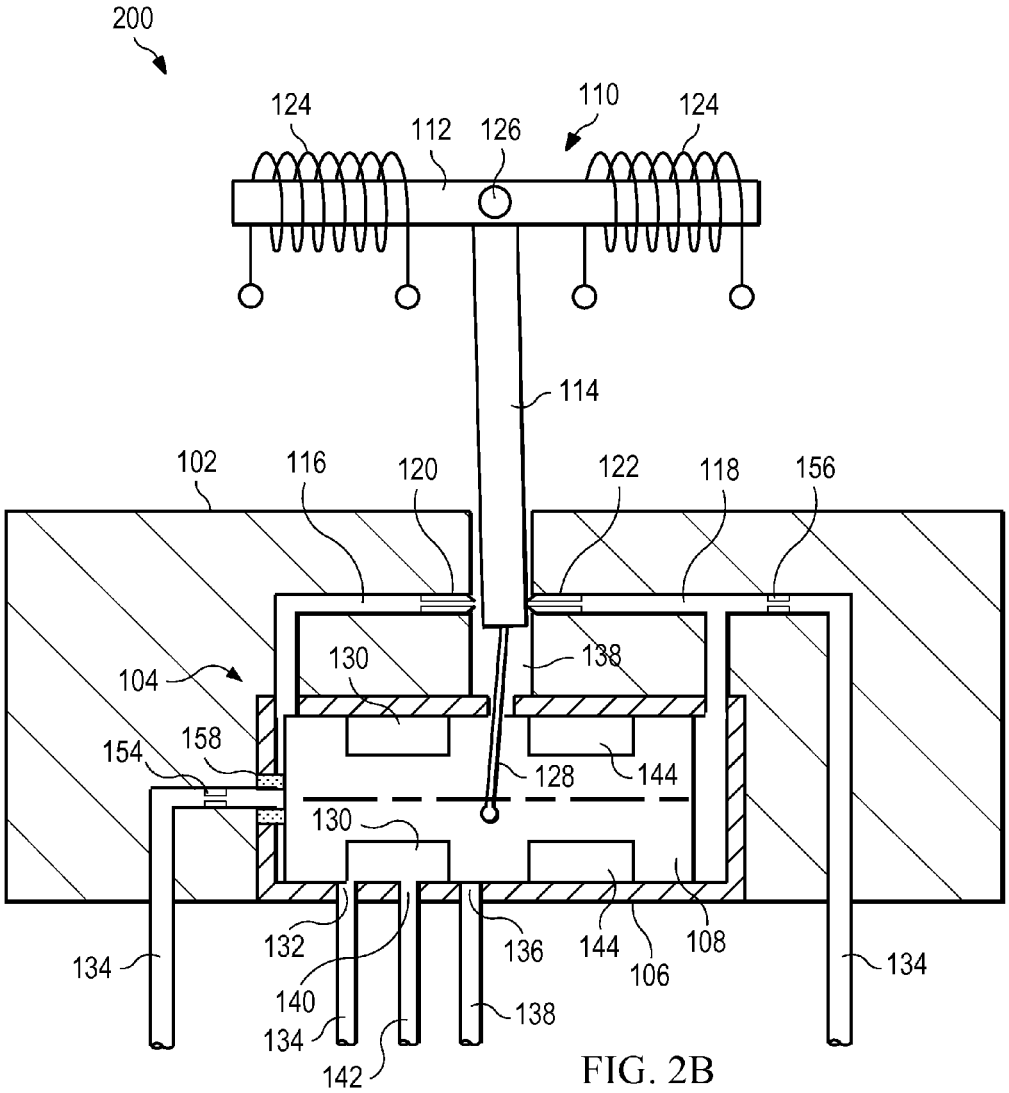

FIGS. 2A and 2B show an example EHSV 200 in schematic front views. The example EHSV 200 is like the example EHSV 100 of FIG. 1, except the example EHSV 200 does not include a second opening in the sidewall of the sleeve 106 fluidly connected to the high pressure fluid pathway 134, a second opening in the sidewall of the sleeve 106 fluidly connected to the low pressure fluid pathway 138, and an opening in the sidewall of the sleeve 106 fluidly connected to a second output fluid pathway. In some instances, the example EHSV 200 includes the second opening to the high pressure fluid pathway 134, the second opening to the low pressure fluid pathway 138, and the opening to the second output fluid pathway.

FIG. 2A illustrates the example EHSV 200 in a center position, where the closure portion 114 of the flapper assembly 110 is not engaged with the first fluid flow control element 120 or the second fluid flow control element 122, and the piston 108 is generally centered in the sleeve 106. FIG. 2B shows the example EHSV 200 in a first position, where the closure portion 114 is engaged with the second fluid flow control element 122 and the piston 108 is engaged with the third fluid flow control element 158. In some instances, an electrical input to the coils 124 moves the flapper assembly 110 such that the closure portion 114 engages the second fluid flow control element 122, thereby blocking fluid flow from the second fluid pressure pathway 118 from leaking into the low pressure fluid pathway 138 and allowing fluid flow from the high pressure fluid pathway 134 to enter the second fluid pressure pathway 118. A higher pressure in the second fluid pressure pathway 118 relative to the pressure in the first fluid pressure pathway 116 creates a pressure differential between the first fluid pressure pathway 116 and second fluid pressure pathway 118. The pressure differential effects translation of the piston 108 in a first direction (e.g. toward the first fluid pressure pathway 116) to engage the third fluid flow control element 158, thereby blocking fluid leakage from the high pressure fluid pathway 134 into the first fluid pressure pathway 116. In certain instances, translation of the piston 108 in the first direction effects a high pressure fluid through the output fluid pathway 142. In other instances, translation of the piston 108 in a second, opposite direction from the first direction effects a low pressure fluid through the output fluid pathway 142.

Figure 3A:
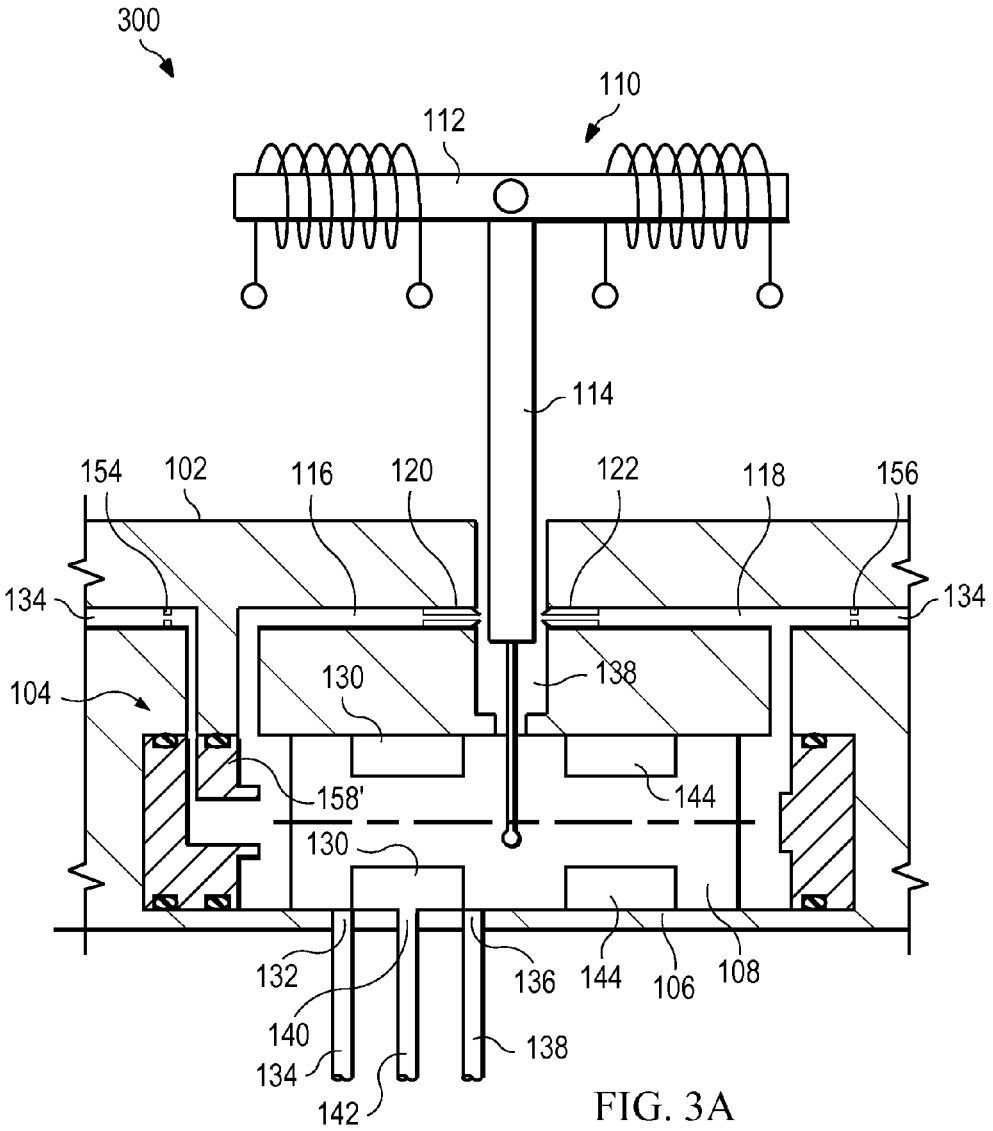
FIGS. 3A through 3C are schematic front views of an example servo valve in a center position, a first position, and a second position, respectively.
Figure 3B:
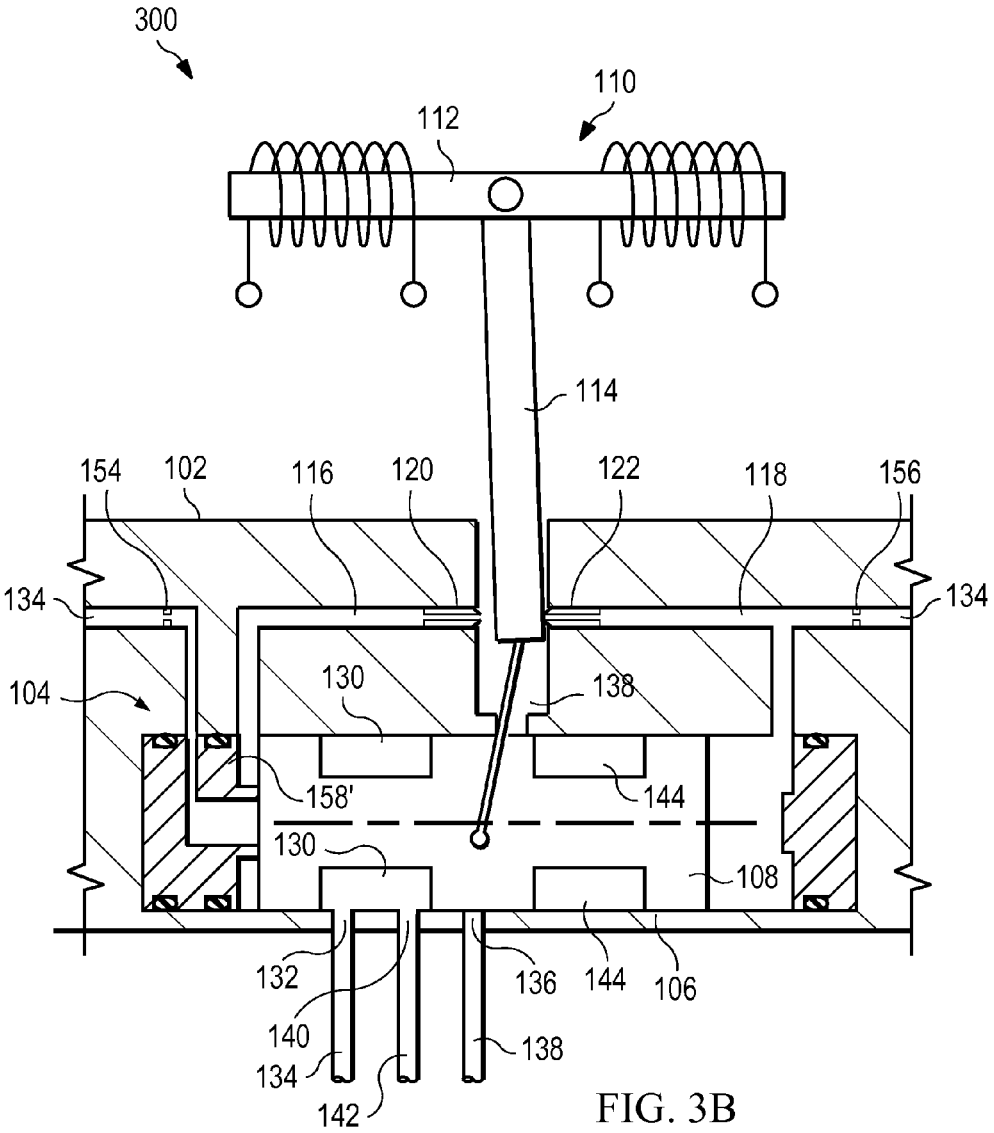
Figure 3C:
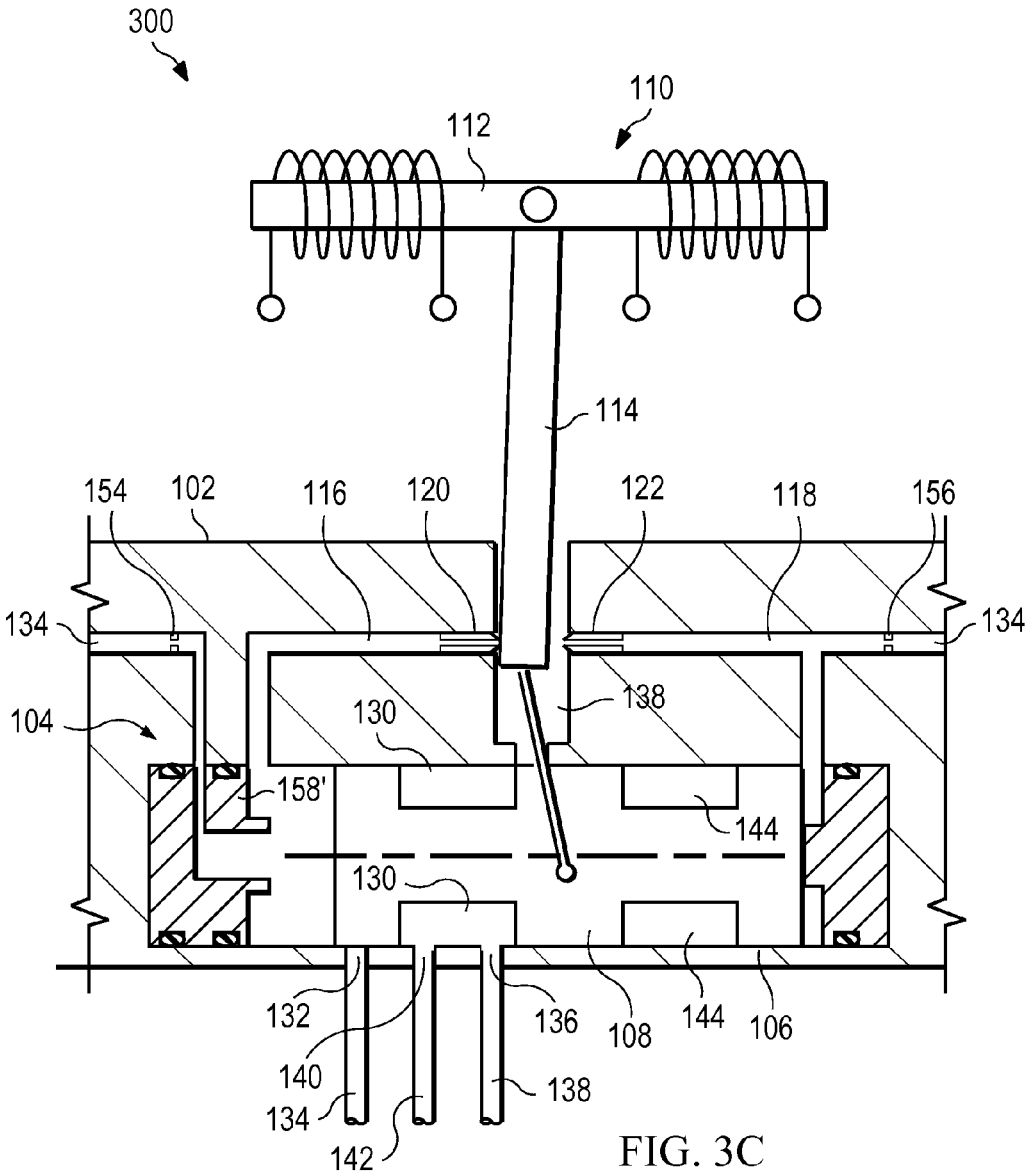

FIGS. 3A through 3C show an example servo valve 300 in schematic front views. The example servo valve 300 includes components of the example EHSV 200 of FIGS. 2A and 2B, except the third fluid flow control element is different. The servo valve 300 includes a third fluid flow control element 158' disposed in the piston cylinder 104 in a portion of the first fluid pressure pathway 116. The third fluid flow control element 158' is configured to stop a flow of fluid through the first fluid pressure pathway 116 when the piston 108 engages the third fluid flow control element 158'. In the example servo valve 300 of FIGS. 3A, 3B, and 3C, the third fluid flow control element 158' includes a fixed protrusion from the housing 102 into the first fluid pressure pathway 116. FIG. 3A illustrates the servo valve 400 in the center position, and FIG. 3B illustrates the servo valve 300 in the first position. FIG. 3C illustrates the servo valve 300 in a second position, where the closure portion 114 is engaged with the first fluid flow control element 120 and the piston 108 is engaged with an end of the sleeve 106. In some instances, the flapper assembly 110 is activated such that the closure portion 114 engages the first fluid flow control element 120, thereby blocking fluid flow from the first fluid pressure pathway 116 from leaking into the low pressure fluid pathway 138 and allowing fluid flow from the high pressure fluid pathway 134 to enter the first fluid pressure pathway 116. A higher pressure in the first fluid pressure pathway 116 relative to the pressure in the second fluid pressure pathway 118 creates a pressure differential between the first fluid pressure pathway 116 and second fluid pressure pathway 118. The pressure differential effects translation of the piston 108 in a second direction (e.g. toward the second fluid pressure pathway 118) to engage the end of the sleeve 106.

FIG. 4 shows an example servo valve 400 in a schematic front view, where the servo valve 400 is in the second position like the servo valve 300 in FIG. 3C. The example servo valve 400 is like the example servo valve 300 of FIGS. 3A, 3B, and 3C, except the example servo valve 400 includes a fourth fluid flow control element 160 disposed in the piston cylinder 104 in a portion of the second fluid pressure pathway 118. The fourth fluid control element 160 is configured to stop a flow of fluid through the second fluid pressure pathway 118 when the piston 108 engages the fourth fluid flow control element 160. In the example servo valve 400 of FIG. 4, the fourth fluid flow control element 160 includes a fixed protrusion from the housing 102 into the second fluid pressure pathway 118. In other instances, the fourth fluid control element 160 includes elements and components of the third fluid flow control element 158 of FIG. 1.

In some instances, the flapper assembly 110 is activated such that the closure portion 114 engages the first fluid flow control element 120, thereby blocking fluid flow from the first fluid pressure pathway 116 from leaking into the low pressure fluid pathway 138 and allowing fluid flow from the high pressure fluid pathway 134 to enter the first fluid pressure pathway 116. A higher pressure in the first fluid pressure pathway 116 relative to the pressure in the second fluid pressure pathway 118 creates a pressure differential between the first fluid pressure pathway 116 and second fluid pressure pathway 118. The pressure differential effects translation of the piston 108 in a second direction (e.g. toward the second fluid pressure pathway 118) to engage the fourth fluid flow control element 160, thereby blocking fluid leakage from the high pressure fluid pathway 134 into the second fluid pressure pathway 118.

One or more of the following advantages may be achieved by the apparatus, systems, and methods described below: reduced fluid leakage; reduced fluid input pump size; heat load, size, weight, and cost reductions; and/or ability to shut off leakage while controlling hydraulic output.

In the foregoing description of the example servo valves 100, 200, 300, and 400, various components, such as seals, bearings, fasteners, fittings, cables, channels, piping, etc., may have been omitted to simply the description. However, those skilled in the art will realize that such conventional equipment can be employed as desired. Those skilled in the art will further appreciate that various components described are recited as illustrative for contextual purposes and do not limit the scope of this disclosure.

Further, the use of a reference axes throughout the specification and/or claims is for describing the relative positions of various components of the system, apparatus, and other elements described herein. Unless otherwise stated explicitly, the use of such terminology does not imply a particular position or orientation of any components during operation, manufacturing, and/or transportation.

A number of embodiments of the invention have been described. Nevertheless, it will be understood that various modifications may be made without departing from the spirit and scope of the inventions.

The invention claimed is:

1. A servo valve comprising:

a valve housing;

a piston cylinder disposed in the housing;

a piston disposed within the piston cylinder, the piston cylinder being fluidly connected on a first end to a first fluid pressure pathway and fluidly connected on a second end to a second fluid pressure pathway, the piston configured to translate axially within the piston cylinder in response to a pressure differential between a first fluid in the first fluid pressure pathway and a second fluid in the second fluid pressure pathway;

a flapper assembly including an activation portion and closure portion, said closure portion of the flapper assembly extending from the activation portion, said flapper assembly configured to move said closure portion to engage a first nozzle on the first fluid pressure pathway when the closure portion is in a first position and configured to move said closure portion to engage a second nozzle on the second fluid pressure pathway when the closure portion is in a second position; and a fluid flow control element disposed in the piston cylinder in a portion of the first fluid pressure pathway and comprising a surface that is sealable with a surface of the piston, the piston configured to seal the first fluid pressure pathway and stop a flow of fluid through the first fluid pressure pathway when the piston engages the fluid flow control element.

2. The servo valve of claim 1, wherein the piston cylinder comprises a sleeve, and the piston is disposed within the sleeve of the piston cylinder.

3. The servo valve of claim 1, wherein the flapper assembly further comprises one or more electrical coils disposed proximal to the activation portion of the flapper assembly.

4. The servo valve of claim 1, further comprising a second fluid flow control element disposed in the piston cylinder in a portion of the second fluid pressure pathway, the piston configured to stop a flow of fluid through the second fluid pressure pathway when the piston engages the second fluid control element.

5. The servo valve of claim 1, wherein an outer periphery portion of the piston pressure-seals against an inner surface of the piston cylinder.

6. The servo valve of claim 1, wherein the first fluid pressure pathway is connected on one end to a high pressure fluid pathway via a first pressure change element and on another end to a low pressure fluid pathway via the first nozzle in the first fluid pathway; and wherein the second fluid pressure pathway is connected on one end to the high pressure fluid pathway via a second pressure change element and on another end to the low pressure fluid pathway via the second nozzle in the second fluid pathway.

7. The servo valve of claim 1, wherein the piston includes an outer groove disposed circumferentially in a substantially cylindrical outer surface of the piston;

wherein the piston cylinder includes an opening in a sidewall of the piston cylinder fluidly connected to a high pressure fluid pathway, an opening in a sidewall of the piston cylinder fluidly connected to a low pressure fluid pathway, and an opening in a sidewall of the piston cylinder fluidly connected to an output fluid pathway;

wherein the opening to the output fluid pathway is positioned in the piston cylinder such that when the groove in the piston translates as the piston moves axially, fluid in the groove remains in fluid communication with the opening to the output fluid pathway;

wherein the opening to the high pressure fluid pathway is spaced apart from and positioned in the sidewall to a first side of the opening to the output fluid pathway, and the opening to the low pressure fluid pathway is spaced apart from and positioned in the sidewall to a second side of the opening to the output fluid pathway in an opposite axial direction from the opening to the high pressure fluid pathway;

wherein the opening to the high pressure fluid pathway is positioned in the piston cylinder such that when the groove in the piston translates as the piston moves axially in a first direction, fluid in the groove remains in fluid communication with the opening to the high pressure fluid pathway and an outer surface of the piston closes the opening to the low pressure fluid pathway; and wherein the opening to the low pressure fluid pathway is positioned in the piston cylinder such that when the groove in the piston translates as the piston moves axially in a second direction opposite the first direction, fluid in the groove remains in fluid communication with the opening to the low pressure fluid pathway and an outer surface of the piston closes the opening to the high pressure fluid pathway.

8. The servo valve of claim 7, wherein the piston includes a second outer groove disposed circumferentially in the substantially cylindrical outer surface of the piston;

wherein the piston cylinder includes a second opening in the sidewall of the piston cylinder fluidly connected to the high pressure fluid pathway, a second opening in the sidewall of the piston cylinder fluidly connected to the low pressure fluid pathway, and an opening in the sidewall of the piston cylinder fluidly connected to a second output fluid pathway;

wherein the opening to the second output fluid pathway is positioned in the piston cylinder such that when the groove in the piston translates as the piston moves axially, fluid in the second groove remains in fluid communication with the opening to the second output fluid pathway;

wherein the second opening to the high pressure fluid pathway is spaced apart from and positioned in the sidewall to a first side of the opening to the second output fluid pathway, and the second opening to the low pressure fluid pathway is spaced apart from and positioned in the sidewall to a second side of the opening to the second output fluid pathway in an opposite axial direction from the second opening to the high pressure fluid pathway;

wherein the second opening to the low pressure fluid pathway is positioned in the piston cylinder such that when the second groove of the piston translates as the piston moves axially in the first direction, fluid in the second groove remains in fluid communication with the second opening to the low pressure fluid pathway and an outer surface of the piston closes the second opening to the high pressure fluid pathway; and wherein the second opening to the high pressure fluid pathway is positioned in the piston cylinder such that when the second groove of the piston translates as the piston moves axially in the second direction, fluid in the second groove remains in fluid communication with the second opening to the high pressure fluid pathway and an outer surface of the piston closes the second opening to the low pressure fluid pathway.

9. The servo valve of claim 8, wherein the first mentioned output fluid pathway and the second output fluid pathway are operably connected to a hydraulic drive system.

10. The servo valve of claim 1, further comprising a feedback spring connected to the closure portion of the flapper assembly on one end and the piston on another end.

11. The servo valve of claim 1, wherein the flapper assembly is movably attached to the housing.

12. The servo valve of claim 11, wherein the flapper assembly is rotatably attached to the housing by a pivot, wherein the pivot comprises a pivot spring.

13. A method of operating a servo valve, the method comprising:

providing a servo valve including;

a valve housing;

a piston cylinder disposed in the housing;

a piston disposed within the piston cylinder and fluidly connected on a first end to a first fluid pressure pathway and fluidly connected on a second end to a second fluid pressure pathway, the piston configured to translate axially within the piston cylinder in response to a pressure differential between a first fluid in the first fluid pressure pathway and a second fluid in the second fluid pressure pathway;

a flapper assembly including an activation portion and closure portion, said closure portion of the flapper assembly extending from the activation portion, said flapper assembly configured to move said closure portion to engage a first fluid flow control element on the first fluid pressure pathway when the closure portion is in a first position and configured to move said closure portion to engage a second fluid flow control element on the second fluid pressure pathway when the closure portion is in a second position; and a third fluid flow control element disposed in the piston cylinder in a portion of the first fluid pressure pathway, the third fluid flow control element configured to stop a flow of fluid through the first fluid pressure pathway when the piston engages the third fluid control element; and moving the closure portion of the flapper assembly to a first position wherein the closure portion of the flapper assembly engages with the second flow control element, resulting in a pressure differential between the first fluid pressure pathway and second fluid pressure pathway that translates the piston within the piston cylinder to a first position, wherein the piston engages the third flow control element to seal the first fluid pressure pathway.

14. The method of claim 13, further comprising moving the closure portion of the flapper assembly to a second position; and wherein the closure portion engages with the first flow control element, resulting in a pressure differential between the first fluid pressure pathway and second fluid pressure pathway that translates the piston within the piston cylinder to a second position, wherein the piston engages a fourth flow control element to seal the second fluid pressure pathway; and wherein the fourth flow control element is disposed in the piston cylinder in a portion of the second fluid pressure pathway, the fourth flow control element configured to stop a flow of fluid through the second fluid pressure pathway when the piston engages the fourth fluid control element.

15. The method of claim 13, wherein moving the closure portion of the flapper assembly to a first position comprises providing an electrical input to one or more coils disposed proximal to the activation portion of the flapper assembly and thereby moving the closure portion of the flapper assembly to a first position.

16. The method of claim 13, wherein the servo valve further comprises:

an outer groove disposed circumferentially in a substantially cylindrical outer surface of the piston; and wherein the piston cylinder includes an opening in a sidewall of the piston cylinder fluidly connected to a high pressure fluid pathway, an opening in a sidewall of the piston cylinder fluidly connected to a low pressure fluid pathway, and an opening in a sidewall of the piston cylinder fluidly connected to an output fluid pathway;

wherein the opening to the output fluid pathway is positioned in the piston cylinder such that when the groove of the piston translates as the piston moves axially, fluid in the groove remains in fluid communication with the opening to the output fluid pathway;

wherein the opening to the high pressure fluid pathway is spaced apart from and positioned in the sidewall to a first side of the opening to the output fluid pathway, and the opening to the low pressure fluid pathway is spaced apart from and positioned in the sidewall to a second side of the opening to the output fluid pathway in an opposite axial direction from the opening to the high pressure fluid pathway;

wherein the opening to the high pressure fluid pathway is positioned in the piston cylinder such that when the groove in the piston translates as the piston moves axially in a first direction, fluid in the groove remains in fluid communication with the opening to the high pressure fluid pathway and an outer surface of the piston closes the opening to the low pressure fluid pathway; and wherein the opening to the low pressure fluid pathway is positioned in the piston cylinder such that when the groove in the piston translates as the piston moves axially in a second direction opposite the first direction, fluid in the groove remains in fluid communication with the opening to the low pressure fluid pathway and an outer surface of the piston closes the opening to the high pressure fluid pathway.

17. The method of claim 16, further comprising connecting the output fluid pathway to a hydraulic drive system.

18. The method of claim 13, wherein the third fluid flow control element comprises an inlet opening of the first fluid pressure pathway into the piston cylinder proximate the first end of the piston cylinder, wherein the piston is configured to engage and block the inlet opening when the piston translates toward the first end of the piston cylinder.

19. The method of claim 13, wherein the third fluid flow control element comprises a seat disposed in the piston cylinder within a portion of the first fluid pressure pathway, wherein the piston is configured to engage and seal against the seat when the piston translates toward the first end of the piston cylinder.

20. The method of claim 13, wherein the third fluid flow control element comprises a protrusion extending from an end of the piston into the first fluid pressure pathway, wherein the protrusion is configured to seal against and engage a portion of the first fluid pressure pathway when the piston translates toward the first end of the piston cylinder.

21. The method of claim 13, wherein the third fluid flow control element comprises a fixed protrusion extending from the housing into the first fluid pressure pathway, wherein the piston is configured to engage the fixed protrusion and seal the first fluid pressure pathway when the piston translates toward the first end of the piston cylinder.

22. The servo valve of claim 1, wherein the fluid flow control element comprises an inlet opening of the first fluid pressure pathway into the piston cylinder proximate the first end of the piston cylinder, wherein the piston is configured to engage and block the inlet opening when the piston translates toward the first end of the piston cylinder.

23. The servo valve of claim 1, wherein the fluid flow control element comprises a seat disposed in the piston cylinder within a portion of the first fluid pressure pathway, wherein the piston is configured to engage and seal against the seat when the piston translates toward the first end of the piston cylinder.

24. The servo valve of claim 1, wherein the fluid flow control element comprises a fixed protrusion extending from the housing into the first fluid pressure pathway, wherein the piston is configured to engage the fixed protrusion and seal the first fluid pressure pathway when the piston translates toward the first end of the piston cylinder.

25. A servo valve comprising:

a valve housing;

a piston cylinder disposed in the housing;

a piston disposed within the piston cylinder, the piston cylinder being fluidly connected on a first end to a first fluid pressure pathway and fluidly connected on a second end to a second fluid pressure pathway, the piston configured to translate axially within the piston cylinder in response to a pressure differential between a first fluid in the first fluid pressure pathway and a second fluid in the second fluid pressure pathway;

a flapper assembly including an activation portion and closure portion, said closure portion of the flapper assembly extending from the activation portion, said flapper assembly configured to move said closure portion to engage a first nozzle on the first fluid pressure pathway when the closure portion is in a first position and configured to move said closure portion to engage a second nozzle on the second fluid pressure pathway when the closure portion is in a second position; and a fluid flow control element comprising a protrusion extending from an end of the piston into the first fluid pressure pathway, the protrusion comprising a surface that is sealable with a surface of the first fluid pressure pathway, the protrusion configured to seal the first fluid pressure pathway and stop a flow of fluid through the first fluid pressure pathway when the piston translates toward the first end of the piston cylinder and the protrusion engages the surface of the first fluid pressure pathway.

* * * * *